US005814109A

United States Patent [19]

Cook et al.

[11] Patent Number: 5,814,109

[45] **Date of Patent: *Sep. 29, 1998**

[54] DIESEL ADDITIVE FOR IMPROVING CETANE, LUBRICITY, AND STABILITY

[75] Inventors: Bruce R. Cook, Pittstown; Paul J. Berlowitz, East Windsor, both of N.J.; Robert J. Wittenbrink, Baton Rouge, La.

[73] Assignee: Exxon Research and Engineering Company, Florham Park, N.J.

[ * ] Notice: The term of this patent shall not extend beyond the expiration date of Pat. No. 5,689,031.

[21] Appl. No.: 798,384

[22] Filed: Feb. 7, 1997

[51] Int. Cl.[6] ..... C10L 1/18; C07C 5/27

[52] U.S. Cl. ..... 44/300; 44/451; 585/733; 585/734; 585/737

[58] Field of Search ..... 44/300, 451

[56] References Cited

U.S. PATENT DOCUMENTS

| | | | |
|---|---|---|---|
| 4,125,566 | 11/1978 | Trin Dinh et al. | 208/17 |
| 4,919,786 | 4/1990 | Hamner et al. | 208/27 |
| 4,943,672 | 7/1990 | Hamner et al. | 585/737 |
| 5,059,741 | 10/1991 | Foley | 585/734 |
| 5,292,989 | 3/1994 | Davis | 585/751 |
| 5,324,335 | 6/1994 | Benham et al. | 44/451 |
| 5,362,378 | 11/1994 | Borghard et al. | 208/138 |
| 5,378,348 | 1/1995 | Davis et al. | 208/27 |
| 5,689,031 | 11/1997 | Berlowitz et al. | 585/734 |

*Primary Examiner*—Ellen M. McAvoy
*Attorney, Agent, or Firm*—Jay Simon

[57] ABSTRACT

A process for producing additive compositions, especially via a Fischer-Tropsch reaction, useful for improving the cetane number or lubricity, or both the cetane number and lubricity, of a mid-distillate, diesel fuel. In producing the additive, the product of a Fischer-Tropsch reaction is separated into a high boiling fraction and a low boiling, e.g., a 700° F.– fraction. The high boiling fraction is hydroisomerized at conditions sufficient to convert it to a 700° F.– low boiling fraction, the latter being blended with the 700° F.– fraction and the diesel additive is recovered therefrom.

12 Claims, 1 Drawing Sheet

DIESEL ADDITIVE FOR IMPROVING CETANE, LUBRICITY, AND STABILITY

FIELD OF THE INVENTION

This invention relates to an additive for diesel fuels. More particularly, this invention relates to an additive that can provide cetane improvement, lubricity improvement and stability of diesel fuels regardless of their hydrocarbon source, i.e., natural or synthetic crudes.

BACKGROUND OF THE INVENTION

The continuing pressure from regulatory agencies around the world for reducing emissions, e.g., particulates, from diesel engines has lead to increased demand for high cetane diesel fuels. This demand has been met, but only in part, by blending refinery streams, e.g., raw or hydrotreated cat cracker, coker distillate, and virgin distillates that contain few, if any, paraffins with distressed streams of low native cetane. Also, cetane of refinery streams can be improved with severe hydrotreating which is expensive and limits cetane to the mid-fifties. Alternatively, commercial cetane additives, e.g., alkyl nitrates and peroxides, are available but expensive, often toxic, and therefore, limited as to the amount that can be used. Consequently, there is a need for an environmentally benign material that can significantly increase cetane, for example increasing cetane number leads to decreasing emissions of pollutants. Further, in severely hydrotreated materials lubricity is often inadequate and lubricity additives are required, too.

SUMMARY OF THE INVENTION

In accordance with this invention a diesel fuel additive that contributes cetane, lubricity, and stability to diesel fuel blends can be prepared from the Fischer-Tropsch hydrocarbon synthesis process, preferably a non-shifting process.

The diesel additive which can be blended with diesel fuel streams in amounts of at least about 1 wt % can be described as boiling range 540°–680° F.;

≧90 wt % $C_{16}$–$C_{20}$paraffins, of which greater than 50 wt % are isoparaffins having substantial, i.e., ≧25 wt %, mono-methyl paraffins;

cetane number of ≧87;

≧2500 ppm as oxygen of $C_{14}$–$C_{16}$ linear, primary alcohols.

Additionally, such materials contain few unsaturates, e.g., ≦1 wt % ppm total unsaturates (olefins+aromatics), preferably less than about 0.5 wt %; and nil sulfur and nitrogen, e.g., ≦50 ppm by wt S or N. These materials are readily produced via a non-shifting Fischer-Tropsch (F/T) catalytic process followed by hydroisomerizing at least a portion of the heavier portion of the F/T product and blending it back with at least a portion of a lighter non-isomerized fraction and recovering the desired material.

Figure 1:
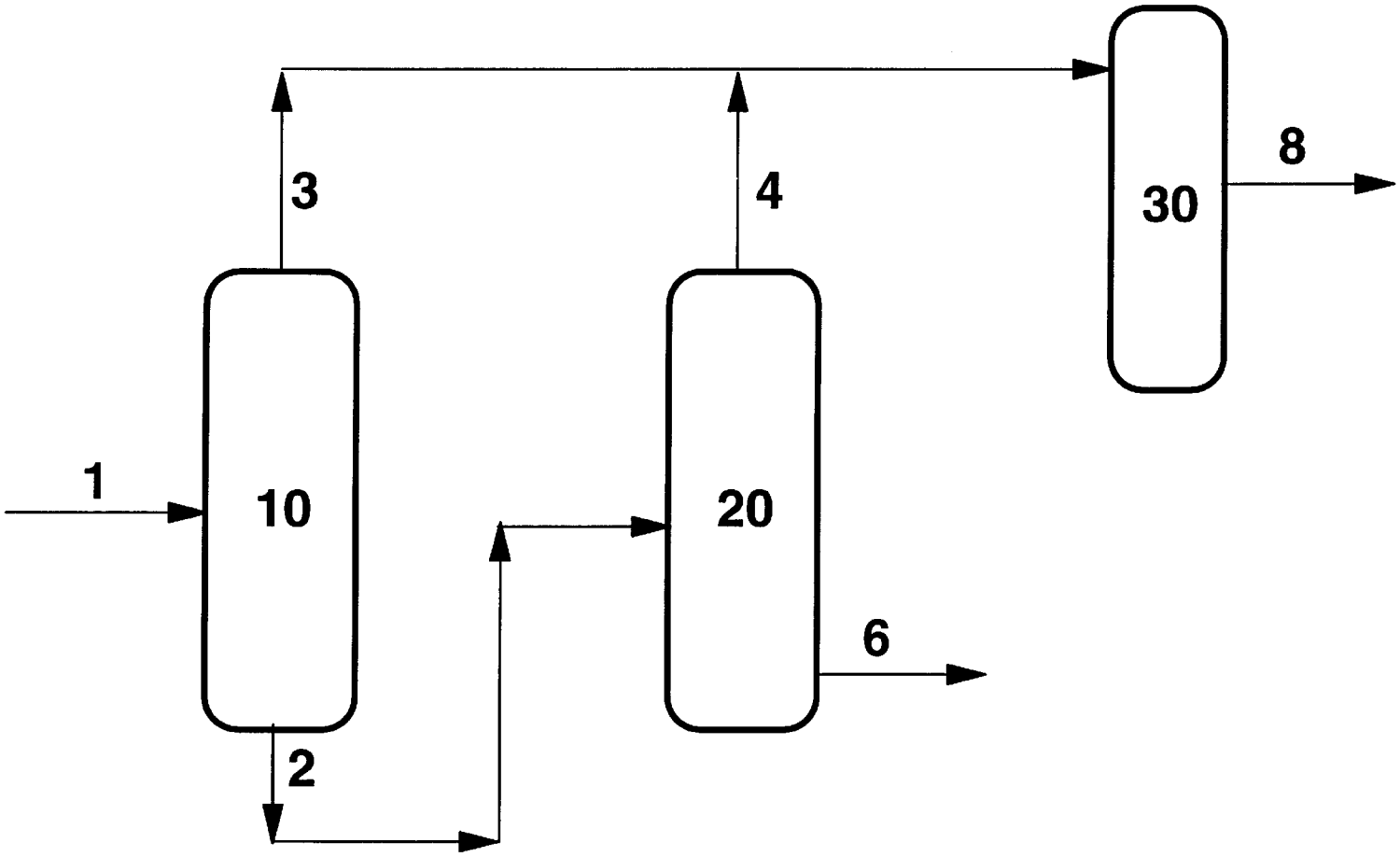
FIG. 1 is a schematic representation of a process for producing the desired diesel fuel additive.

The diesel material of this invention, preferably produced in accordance with the process described herein, is best employed as a blending agent with other diesel fuels in need of upgrading, that is, upgrading or increasing cetane number, increasing lubricity, increasing stability, or any combination of the foregoing. The amount of additive employed will be that amount sufficient to improve the cetane or lubricity or both of the blend to meet desired specifications.

More preferably, diesel materials having a cetane number in the range 30–55, preferably less than about 50, preferably less than about 40 or diesel materials having lubricity measurements of less than 2500 grams in the. scuffing BOCLE test or greater than 450 microns wear scar in the High Frequency Reciprocating Rig (HFRR) test, or both low cetane and poor lubricity are excellent candidates for upgrading with the diesel fuel additive of this invention.

There is essentially no upper limit on the amount of additive that can be used other than economic limits. In general, the diesel additive of this invention is used as a blend with diesel materials that are or can be used as diesel fuels in amounts of at least about 1 wt %, preferably in amounts of about 1–50%, more preferably in amounts of about 2 to 30%, and still more preferably in amounts of about 5–20%. (For rough estimation purposes about 1% additive will increase cetane number by about 0.5; and about 2–10% additive will improve lubricity by about 20% in the scuffing BOCLE test.)

Examples of distressed diesel materials requiring upgrading are raw and hydrotreated cat cracker and coker distillates. These materials are usually low in cetane number, being less than about 50, sometimes less than about 40. Additionally, hydrotreated distillates in the diesel boiling range, particularly where sulfur and nitrogen are less than 50 wppm and oxygenates are nil, can have their lubricity increased by virtue of blending with the diesel additive of this invention.

The BOCLE test is described in Lacy, P. I. "The U.S. Army Scuffing Load Wear Test", Jan. 1, 1994 which is based in ASTM D5001.

The HFRR test is described in "Determination of Lubricity of Diesel Fuel by High Frequency Reciprocating Rig (HFRR) Test". ISO Provisional Standard , TC22/SC7N595, 1995 and in "Pending ASTM Method: Standard Test Method for Evaluating Lubricity of Diesel Fuels by the High-Frequency Reciprocating Rig (HFRR)" 1996.

This invention, as described in the embodiment shown in FIG. 1 is based, in part, on the discovery that a fractionated, hydroisomerized product obtained from a non-shifting Fischer-Tropsch process does not behave in a usual fashion. That is, usually, as molecular weight increases, cetane number also increases. However, as the boiling point of a particular fraction increases after hydroisomerizing, the iso- to normal ratio also increases and as the iso/normal ratio increases, the cetane number decreases. Consequently, with increasing molecular weight and increasing iso/ normal ratio, a maximum cetane number occurs for a particular fraction. Also, at this maximum cetane, the cloud point, which also increases with increasing molecular weight, is acceptable and that fraction contains virtually nil unsaturates (for stability) and linear, primary alcohols which impart lubricity.

In the practice of this invention, the paraffinic stream from the F/T reactor is split, or divided, into (i) a high boiling liquid fraction and (ii) a low boiling liquid fraction, the split being made nominally at temperature ranging between about 675° F. and about 725° F., preferably at about 700° F. to produce a nominally 700° F.+ liquid fraction and a 700° F.− liquid fraction. The high boiling or preferred 700° F.+ fraction (i) is mildly hydroisomerized and hydrocracked to produce a 700° F.− boiling product which is then combined with the native low boiling, or 700° F.− boiling liquid fraction (ii), and this mixture is then separated, i.e., suitably fractionated, to produce very stable, environmentally benign, non-toxic, mid-distillate, diesel fuel additive.

Referring to the FIGURE there is shown a schematic for producing the desired fraction that is useful as a diesel fuel improver. Hydrogen and carbon monoxide is fed in line 1 into Fischer-Tropsch reactor 10 at reaction conditions. From the reactor 10 a product is recovered and may, for example, be recovered as a lighter stream or a heavier stream. The split may be at nominally 250° F., preferably 500° F., more preferably 700° F. Consequently, in the most preferred embodiment the lighter stream may be a 700° F.− while the heavier stream is a 700° F.+, lines 3 and 2, respectively. The heavier stream is then hydroisomerized in reactor 20 from which a 700° F.− stream is recovered in line 4 and combined with the lighter product of line 3. The combined stream is fractionated in fractionator 30 from which the desired diesel blending fraction is recovered in line 8. Additional 700° F.+ material from line 6 can be recovered, and if desired, recycled to reactor 20 for the production of additional 700° F.− material.

Non-shift F/T reaction conditions are well known to those skilled in the art and can be characterized by conditions that minimize the formation of carbon dioxide byproducts. Non-shift F/T conditions can be achieved by a variety of methods, including one or more of the following: operating at relatively low carbon monoxide partial pressures, that is, operating at hydrogen carbon monoxide ratios of at least about 1.7:1, preferably about 1.7:1 to about 2.5:1, more preferably at least about 1.9:1, and in the range 1.9:1 to about 2.3:1 with an alpha of at least about 0.88, preferably at least about 0.91; temperatures of about 175°–400° C., preferably about 180°–300° C.; using catalysts comprising cobalt or ruthenium as the primary F/T catalysts, preferably supported cobalt or supported ruthenium, most preferably supported cobalt where the support may be silica, alumina, silica-alumina or Group IVB metal oxides, e.g., titania. Promoters may also be employed, e.g., rhenium, titanium, zirconium, hafnium.

Whereas various catalysts can be used to convert syngas to F/T liquids, supported cobalt and ruthenium catalysts are preferred in that they tend to produce primarily paraffinic products; especially cobalt catalysts which tend toward making a heavier product slate, i.e., a product containing $C_{20}$+. The product withdrawn from the F/T reactor is characterized as a waxy Fischer-Tropsch product, a product which contains $C_5$+ materials, preferably $C_{20}$+ materials, a substantial portion of which are normal paraffins. A typical product slate is shown in Table A and can vary by about ±10% for each fraction.

TABLE A

| Typical product slate from F/T process liquids: | |
|---|---|
| | Wt. % |
| IBP-320° F. | 13 |
| 320-500° F. | 23 |
| 500-700° F. | 19 |
| 700–1050° F. | 34 |
| 1050° F.+ | 11 |
| | 100 |

Table B below lists some typical and preferred conditions for conducting the hydroisomerization reaction.

TABLE B

| CONDITION | TYPICAL RANGE | PREFERRED RANGE |
|---|---|---|
| Temperature, °F. | 300–800 | 600–750 |
| Pressure, psig | 0–2500 | 500–1200 |
| Hydrogen treat rate, SCF/B | 500–5000 | 2000–4000 |
| Hydrogen Consumption rate, SCF/B | 50–500 | 100–300 |

While virtually any bifunctional catalyst may be satisfactorily used for conducting the hydroisomerization reaction, some catalysts perform better than others and are preferred. For example, catalysts containing a supported Group VIII non-noble metal, e.g., platinum or palladium, are useful as are catalysts containing one or more Group VIII metals, e.g., nickel, cobalt, which may or may not also include a Group VI metal, e.g., molybdenum. Group IB metals can also be used. The support for the metals can be any acidic oxide or zeolite or mixtures thereof Preferred supports include silica, alumina, titania, zirconia, vanadia and other Group III, IV, VA or VI oxides, as well as Y sieves, such as ultrastable Y sieves. Preferred supports include alumina and silica-alumina. More preferred catalysts and supports are those described in U.S. Pat. No. 5,187,138 incorporated herein by reference. Briefly, the catalysts described therein contain one or more Group VIII metals on alumina or silica-alumina supports where the surface of the support is modified by addition of a silica precursor, e.g., $Si(OC_2H_5)_4$. Silica addition is at least 0.5 wt. % preferably at least 2 wt. %, more preferably about 2–25%.

In hydroisomerization reactions increasing conversion tends to increase cracking with resultant higher yields of gases and lower yields of distillate fuels. Consequently, conversion is usually maintained at about 35–80% of 700° F.+ feed hydrocarbons converted to 700° F.− hydrocarbons.

In one aspect, the 700° F.− paraffinic mixture obtained from the F/T reactor is fractionated to produce an environmentally friendly, benign, non-toxic additive boiling within the range of from about 540° F. to about 680° F., preferably from about 570° F. to about 650° F., which when combined with mid-distillate, diesel fuels will produce products of outstanding lubricity. These additives will contain generally more than 90 wt %, preferably more than 95 wt %, and more preferably more than 98 wt %, $C_{16}$ to $C_{20}$ paraffins, based on the total weight of the additive, of which greater than 50 wt %, based on the total weight of the paraffins in the mixture, are isoparaffins; and the isoparaffins of the mixture are further defined as greater than 25 percent, preferably greater than 40 percent, and more preferably greater than 50 percent, by weight, mono-methyl paraffins. The additive composition is also rich in $C_{14}$–$C_{16}$ linear primary alcohols species which impart higher lubricity, when combined with a mid-distillate, diesel fuel. In general the linear primary alcohols constitute at least about 0.05 percent, preferably at least about 0.25 percent, and generally from about 0.25 percent to about 2 percent, or more, of the additive mixture, based on the total weight of the additive.

EXAMPLE 1 a) A mixture of hydrogen and carbon monoxide synthesis gas ($H_2$:CO 2.11–2.16) was converted to heavy paraffins in a slurry Fischer-Tropsch reactor. A titania supported cobalt/rhenium catalyst was utilized for the Fischer-Tropsch reaction. The reaction was conducted at 422°–428° F., 287–289 psig, and the feed was introduced at linear velocity of 12 to 17.5 cm/sec. The alpha of the Fischer-Tropsch synthesis step was 0.92. The paraffinic Fischer-Tropsch product was isolated in three nominally different boiling streams, separated by utilizing a rough flash. The three boiling fractions obtained were: 1) a native low boiling $C_5$–500° F. fraction, i.e., F/T cold separator liquids; 2) a 500°–700° F. boiling fraction, i.e., F/T hot separator liquids, and 3) a 700° F.+ boiling fraction, i.e., or F/T reactor wax.

b) The 700° F.+ boiling fraction, or F/T reactor wax, having a boiling point distribution as follows: IBP–500° F., 1.0%, 500° F.–700° F., 28.1%, and 700° F.+, 70.9%, was then hydroisomerized and hydrocracked over a dual functional catalyst consisting of cobalt (CoO, 3.2 wt. %) and molybdenum ($MoO_3$ , 15.2 wt. %) on a silica-alumina cogel acidic support, 15.5 wt. % of which is $SiO_2$ to obtain a 700° F.– product. The catalyst had a surface area of 266 m/g and pore volume ($PV_{H2O}$) of 0.64 ml/g. The conditions for the reaction are listed in Table 1A and were sufficient to provide approximately 50% 700° F.+ conversion where 700° F.+ conversion is defined as 700° F.+Conv.=[1−(wt. % 700° F.+ in product)/(wt. % 700° F.+ in feed)]×100

TABLE 1A

| Operating Conditions | |
|---|---|
| Temp., °F. | 690 |
| LHSV, v/v/h | 0.6–0.7 |
| $H_2$ Pressure, psig (pure) | 725 |
| $H_2$ Treat rate, SCF/B | 2500 |

c) To simulate the total of the 700° F.– liquids derived in steps (a) and (b), above, seventy-eight wt. % hydroisomerized F/T reactor wax boiling at 700° F.–, 12 wt. % F/T cold separator liquids, and 10 wt. % F/T hot separator liquids from a large scale pilot unit were combined and mixed. A final diesel fuel, i.e., a 250°–700° F. boiling fraction was isolated by distillation from this blend. The hydroisomerized F/T reactor wax was prepared in flow through, fixed bed unit using a cobalt and molybdenum promoted amorphous silica-alumina catalyst, as described in U.S. Pat. No. 5,292,989 and U.S. Pat. No. 5,378,348.

d) The diesel fuel of step (c), above, was fractionated using a 15/5 distillation column into 9 cuts of increasing boiling range. These cuts, the mid-boiling points and engine cetane number of each fraction are listed in Table 1B. A composite 33%–55% volume fraction was also made and is shown in this table.

TABLE 1B

| Cut# | Volume Fraction | Initial B.P. (°F.) | 50% B.P. (°F.) | Final B.P. (°F.) | Engine Cetane Number |
|---|---|---|---|---|---|
| 1 | 0–10% | 206 | 317 | 383 | 60.7 |
| 2 | 10–20% | 294 | 398 | 469 | 70.5 |
| 3 | 20–30% | 354 | 461 | 536 | 77.4 |
| 4 | 30–40% | 419 | 515 | 560 | 83.2 |
| 5 | 40–50% | 461 | 551 | 590 | 84.3 |
| 6 | 50–60% | 494 | 578 | 612 | 84.1 |
| 7 | 60–70% | 544 | 610 | 645 | 88.5 |
| 8 | 70–80% | 571 | 641 | 676 | 87.9 |
| 9 | 80–100% | 605 | 691 | 737 | 81.6 |
| | 33–55% | 500 | | 570 | 84 |
| | 60–80% | 570 | | 670 | 88 |

All of the fractions, as clearly evident, exhibit high engine cetane numbers, with fractions 7 and 8 having the highest cetane. The cetane number of a composite of the 33–55% volume fraction has a cetane number of 84. Cetane number is clearly not simply a function of boiling point, as the highest boiling fraction 9 has a significantly lower cetane number than 7 and 8. The 33–55% composite fraction, and 60–80% composite fractions were in fact found to contain distinctive molecular compositions that lead to these improved properties.

In Table 1C is given a projected combination of Fractions 7+8 (60%–80%), from the analysis of the individual fractions by GC and GC/MS. The linear primary alcohol content leads to improved lubricity; lubricity increasing as the alcohol content of the fraction is increased.

TABLE 1C

| Wt. % Paraffin Carbon | |
|---|---|
| $C_{15}$ | 0.2 |
| $C_{16}$ | 3.2 |
| $C_{17}$ | 22.4 |
| $C_{18}$ | 37.5 |
| $C_{19}$ | 28.4 |
| $C_{20}$ | 8.0 |
| $C_{21}$ | 0.2 |
| Iso/Normal | 1.34 |
| wppm linear primary alcohols: | |
| $C_{14}$ | 267 |
| $C_{15}$ | 1740 |
| $C_{16}$ | 1024 |

In Table 1D is given a projected combination of cuts 4, 5 and 6 which encompasses the 33–55% volume fraction. Analysis of the individual fractions by GC and GC/MS show that the fractions contain relatively high concentrations of linear primary alcohols. The linear primary alcohol content leads to improved lubricity; lubricity increasing as the alcohol content of the fraction is increased.

TABLE 1D

| Wt. % Paraffin Carbon | |
|---|---|
| $C_{14}$ | 2.8 |
| $C_{16}$ | 54.8 |
| $C_{17}$ | 42.3 |
| Iso/Normal | 1.21 |
| wppm linear primary alcohols: | |
| $C_{12}$ | 379 |
| $C_{13}$ | 4404 |
| $C_{14}$ | 1279 |

The following Table 1E is a further tabulation of tests performed on the 9 cuts, and a composite of the 9 cuts, showing the lubricity in terms of the BOCLE test, the Peroxide No., and the cloud and pour points.

TABLE 1E

| Cut | Lubricity[1] | Peroxide No.[2] | Cloud[3] | Pour[4] |
|---|---|---|---|---|
| 1 | 33 | 76.0 (Fail) | <−49 | <−49 |
| 2 | 35 | 6.7 (Fail) | <−45 | <−45 |
| 3 | 55 | 2.0 (Fail) | <−27 | <−28 |
| 4 | 73 | 0.6 (Pass) | <−15 | <−15 |
| 5 | 75 | 0.9 (Pass) | −4 | −3 |
| 6 | 93 | 0.7 (Pass) | 2 | 3 |
| 7 | 102 | 0.3 (Pass) | 6 | 6 |
| 8 | 117 | 0.0 (Pass) | 8 | 9 |
| 9 | 129 | 0.4 (Pass) | 13 | 12 |
| Sum Cuts 1–9[5] | 75 | 7.5 (Pass) | −8 | −8 |
| 33–55% Volume | >75 | <1 (Pass) | <−5 | <−5 |

TABLE 1E-continued

| Cut | Lubricity[1] | Peroxide No.[2] | Cloud[3] | Pour[4] |
|---|---|---|---|---|
| Fraction[6] | | | | |

Notes:
[1]Lubricity results in the BOCLE test as described in Lacy, P.I. "The U.S. Army Scuffing Load Wear Test", Jan. 1, 1994 which is based in ASTM D5001. Results are represented as a % of the high reference fuel, Cat 1-K specified in the procedure.
[2]Peroxide number according to ASTM D3703. 100 mls of fuel were filtered, then aerated for 3 minutes with air, and then placed in a brown 4 oz. bottle in a 65 C. oven for 4 weeks. Peroxide number was measured at the start of the test, and after 7, 14, 21 and 28 days. At the end of the test those fuels with peroxide number <1 were considered to have good stability and passed the test.
[3]Cloud point as described by ASTM D2500.
[4]Pour point as described by ASTM D97.
[5]Entire product of cuts 1 through 9 before fractionation.
[6]Estimation from result from cuts 4–6, as a neat fuel.

These data thus show materials which can provide significant benefits to cetane number and lubricity without incurring debits due to oxidative instability or excessively high cloud/pour points. Blending this additive into a base 35 cetane stream at 5–10% produces cetane number improvements of 2.5 to 5 numbers with improved lubricity and essentially no effect on cold flow properties.

We claim:

1. A diesel fuel additive comprising (i) ≧90 wt % $C_{16}$–$C_{20}$ paraffins, of which ≧50% are isoparaffins at least a portion of which are mono-methyl branched;

(ii) cetane number of ≧87;

(iii) ≧2500 ppm as oxygen of $C_{14}$–$C_{16}$ linear, primary alcohols;

(iv) a boiling range of 540°–680° F.

2. The additive of claim 1 wherein the paraffins are ≧95 wt %, and the mono-methyl branched isoparaffins are ≧25 wt %.

3. The additive of claim 2 wherein the $C_{14}$–$C_{16}$ alcohols are present in an amount of 0.25 to 2 wt %.

4. The additive of claim 2 wherein the sulfur and nitrogen concentrations are each ≦50 wppm and the unsaturates concentration ≦1 wt %.

5. The additive of claim 1 derived from a non-shifting Fischer-Tropsch process.

6. The additive of claim 1 blended with diesel material in amount of 1–50 wt %.

7. The diesel material of claim 6 having a cetane of ≦50.

8. The diesel material of claim 6 having a lubricity of less than 2500 grams in the scuffing BOCLE test.

9. The additive of claim 1 blended with diesel material in an amount of about 2–30 wt %.

10. The blend of claim 6 wherein the diesel material is selected from the group consisting of raw and hydrotreated cat cracker and coker distillates having a cetane number ≦40 and hydrotreated distillates in the diesel boiling range having a lubricity of less than 2500 grams in the scuffing BOCLE test.

11. A process for preparing a diesel fuel additive described in claim 1 comprising (a) reacting hydrogen and carbon monoxide at reaction conditions in the presence of a non-shifting Fischer-Tropsch catalyst, (b) recovering at least a portion of the liquid product of the reaction and separating at least a portion of the liquid product into a heavier fraction and a lighter fraction, (c) hydroisomerizing at hydroisomerization conditions at least a portion of the heavier fraction and recovering a 700° F.− product, (d) combining the lighter fraction of step (b) with the 700° F.− product of step (c) and recovering a diesel fuel additive.

12. The process of claim 11 wherein the heavier fraction of step (b) is a 675° F.+ material.

* * * * *